US011369154B2

(12) United States Patent
Hernandez

(10) Patent No.: US 11,369,154 B2
(45) Date of Patent: Jun. 28, 2022

(54) EXTENDED USE MASK HAT AND METHOD FOR CONTROLLING SPREAD OF INFECTION

(71) Applicant: Alexander Luis Hernandez, Thousand Oaks, CA (US)

(72) Inventor: Alexander Luis Hernandez, Thousand Oaks, CA (US)

( * ) Notice: Subject to any disclaimer, the term of this patent is extended or adjusted under 35 U.S.C. 154(b) by 165 days.

(21) Appl. No.: 17/144,636

(22) Filed: Jan. 8, 2021

(65) Prior Publication Data

US 2022/0022573 A1 Jan. 27, 2022

Related U.S. Application Data

(63) Continuation-in-part of application No. 63/055,022, filed on Jul. 22, 2020.

(51) Int. Cl.
*A41D 13/11* (2006.01)
*A42B 1/24* (2021.01)
(Continued)

(52) U.S. Cl.
CPC ..... *A41D 13/1161* (2013.01); *A41D 13/1184* (2013.01); *A41D 31/18* (2019.02); *A42B 1/24* (2013.01); *A62B 23/025* (2013.01)

(58) Field of Classification Search
CPC A41D 13/1161; A41D 13/11; A41D 13/1184; A41D 31/18; A62B 23/025;
(Continued)

(56) References Cited

U.S. PATENT DOCUMENTS 798,877 A * 9/1905 Conne ..... A42B 1/247 2/10
1,505,978 A 8/1924 Stetson
(Continued)

FOREIGN PATENT DOCUMENTS

CN 107467767 A * 12/2017
CN 111184305 A 5/2020
(Continued)

OTHER PUBLICATIONS

Rain Noe. Hide-a-Mask: On-Demand Face Mask That Pops Out of a Baseball Cap. Jul. 16, 2020. Retrieved from: https://www.core77.com/posts/100864/Hide-a-Mask-On-Demand-Face-Mask-That-Pops-Out-of-a-Baseball-Cap#:~:text=The%20Hide%2Da%2DMask%20is,second%20we%20leave%20our%20homes. (Year: 2020).*
(Continued)

*Primary Examiner* — Clinton T Ostrup
*Assistant Examiner* — Aiying Zhao
(74) *Attorney, Agent, or Firm* — IP and Business Law Offices of Howard L. Hoffenberg, Esq.; Howard Leslie Hoffenberg

(57) ABSTRACT

Disclosed here is an extended use mask hat. The principal components are a hat member, a mask member and an attachment means. Under conditions where there is no desire for protection, the mask member can be easily stored against the interior surface of the hat member. When there is a desire for protection, the mask member can be easily and quickly donned. The service period of the mask hat is extendable by washing. Several technological problems are overcome, including, individual and community protection from the airborne spread of infectious disease in a manner that is effective, not noxious to human sensibility and not overly bearing.

18 Claims, 8 Drawing Sheets

(51) Int. Cl.
*A41D 31/18* (2019.01)
*A62B 23/02* (2006.01)

(58) Field of Classification Search
CPC ..... A62B 18/02; A62B 23/084; A42B 1/24; A42B 1/017; A42B 1/018; A42B 1/0181
USPC ..... 2/173
See application file for complete search history.

(56) References Cited

U.S. PATENT DOCUMENTS

| | | | | | |
|---|---|---|---|---|---|
| 3,292,182 | A * | 12/1966 | Schuessler | A42B 1/0186 | 2/173 |
| 3,307,202 | A * | 3/1967 | Schuessler | A42B 1/0186 | 2/173 |
| 5,269,024 | A * | 12/1993 | Wyatt | A41D 13/11 | 2/173 |
| 7,240,372 | B2 * | 7/2007 | Larson | A41D 13/11 | 2/173 |
| 10,609,977 | B1 * | 4/2020 | Stir | A42B 1/18 | |
| 10,687,569 | B1 * | 6/2020 | McDirmid | A42B 3/20 | |
| 2011/0185482 | A1 * | 8/2011 | Godfrey | A41D 23/00 | 2/424 |
| 2017/0055597 | A1 * | 3/2017 | Lekven | A41D 13/1161 | |
| 2020/0085127 | A1 * | 3/2020 | Garmon | A42B 1/0186 | |
| 2020/0093212 | A1 | 3/2020 | Zheng | | |
| 2020/0390177 | A1 * | 12/2020 | Garmon | A42B 1/04 | |

FOREIGN PATENT DOCUMENTS

| | | | |
|---|---|---|---|
| DE | 202020001731 | U1 | 6/2020 |
| GB | 1089144 | | 11/1967 |
| KR | 20080026709 | A | 3/2008 |
| KR | 20120074871 | A | 7/2012 |

OTHER PUBLICATIONS

Centers for Disease Control and Prevention, Scientific Brief; Community Use of Cloth Masks to Control the Spread of SARS-CoV-2, Nov. 10, 2020, https://www.cdc.gov/coronavirus/2019-ncov/more/masking-science-sars-cov2.html.

* cited by examiner

EXTENDED USE MASK HAT AND METHOD FOR CONTROLLING SPREAD OF INFECTION

CROSS REFERENCE TO RELATED APPLICATION

This application claims priority from U.S. Provisional Application Ser. No. 63/055,022 which was filed on Jul. 22, 2020. The entirety of U.S. Provisional Application Ser. No. 63/055,022 which was filed on Jul. 22, 2020 is incorporated herein by reference.

BACKGROUND OF THE INVENTION

1. Field of the Invention

This invention pertains generally to face masks and more particularly to filter face masks and methods for controlling the airborne spread of an infection.

2. Related Art

A corona COVID-19 virus (SARS-Cov-2) pandemic erupted in the United States, and the world, in the year 2020. In response thereto, the U.S. Center for Disease Control, state governments and local governments promulgated public health COVID-19 guidelines and mandatory orders.

These COVID-19 guidelines and orders almost universally specify the wearing of facial masks under certain circumstances and not under other circumstances. Typically, the guidelines/orders recommend/require the wearing of a face mask when indoors, interacting with another individual and/or individuals are not physically distant. Conversely, the guidelines/orders may not recommend/require the wearing of a face masks when outdoors and/or individuals are physically distant from one another.

Human behavior being what it is, a common practice by individuals is to only wear a face mask when the individual believes a mask is needed, there is a recommendation to wear a mask and/or a requirement to wear a face mask. This is because a face mask can be uncomfortable to wear with restricted breathing and the buildup of heat underneath the mask; a detraction from physical appearance and/or a connotation to criminality.

A deficiency in the art of face masks is that face masks are not conveniently storable on-person by individual who does not utilize a purse or handbag and desires to only where a face mask intermittently. A face mask can be placed in a pocket; however, this is unsatisfactory because, a pocket can already be congested with keys, a wallet and a cell phone. Further, a facemask cannot be easily inserted and removed from a pocket.

A related deficiency in the art of face masks is that they are forgettable. An individual can go to a venue which requires the wearing of a face mask and only upon the point of entry, does the individual appreciate not having a face mask. This necessitates the individual to return to a car or home to get a face mask or go to a store to buy a face mask.

Another deficiency in the art of face masks is to be able to rapidly and conveniently go from not wearing a face mask to wearing a face mask and vice versa. An individual may transit from an indoor venue, to an outdoor, to an indoor, from not being around other individuals to being around other individuals. That individual does not have a handy face mask to go conveniently back and forth from wearing and not wearing a face mask.

A discussion now follows of art known at the time of the filing of the application leading to this patent. This discussion, along with other art listed in an Information Disclosure Statement errs on the side of being a candid disclosure. As set forth above, this patent claims priority to a US provisional application filed on filed Jul. 22, 2020. Said art is not necessarily prior art.

Canadian patent CN111184305 A published on May 22, 2020 claiming priority to a Chinese patent application published on Mar. 11, 2020, teaches the combination of a mask and a hat. A prominent feature of the disclosed apparatus is that the mask is buttoned (removably attached/fastened) to the hat to allow for interchangeability of the mask. This mask hat has the shortcoming that a user can don the mask hat without a mask attached thereto and not have a mask on his or her person to attach the hat when wearing a mask is desired. Accordingly, a user must exercise conscious thought to have a mask on-person beyond ritually wearing a hat. The disclosed mask hat also has a shortcoming of no capability to store a mask.

Similarly, German patent DE 202020001731 teaches a mouth guard with a releasable connection to a headgear and Korean patent KR 20120074871 A teaches a mask with string fastener loops that releasably hook unto hanger hooks on the dorsal tensioning mechanism of a helmet. These apparatuses too have the shortcomings that a user can don the headgear/helmet without a guard/masks attached thereto and not have a guard/mask on his or her person to attach to the headgear/helmet when wearing a guard/mask is desired. Accordingly, a user must exercise conscious thought to have a guard/mask on-person beyond ritually wearing the headgear/helmet. The disclosed apparatuses also have the shortcoming of no capability to store the guard/mask.

Korean patent publication number KR 20080026709 A teaches the combination of fan-like mask (spreads open from a compact configuration) and a hat. Taught therein is a complex mechanism for fixedly attaching the fan-like mask to the hat comprised in its simplest form of a first and second pivoting portions, first and second latch portions, third and fourth pivoting portions and one or more ring shaped supports. The disclosed mask hat has a shortcoming of a complex mechanism for attaching the mask to the hat. The disclosed mask also has the shortcoming of no capability to store the mask in a manner that is aesthetically attractive and not annoying. A still further shortcoming is a want of a capability for the mask to be cleaned and thereby extending the use of the mask.

Similarly, taught in US patent publication 2020/0093212 A1 is a mask and hat combination with a complex mechanism for fixedly attaching the mask to the hat comprised a holding unit having a holding unit body; a rotating unit including an arm pivotally connected to the holding unit body; a fixed hanging portion disposed at the arm pivotal end and a spacing adjustment mechanism disposed at the end of the arm and having a movable hanging portion. Disclosed therein is to store the mask on the front of the hat. This apparatus has the shortcoming of a complex mechanism for attaching the mask to the hat. The apparatus also has the shortcoming of storing the mask on the front of the hat which is aesthetically displeasing. The apparatus has the further shortcoming of lacking a quick and easy way to go from wearing the mask over a mouth and nose to being stowed for storage. A still further shortcoming is a want of a capability for the mask to be cleaned and thereby extending the use of the mask.

In Great Britain patent 1,089,144 there is taught a mask hat with the capability of storing the mask in a position on the back of the hat. A prominent feature of the disclosed apparatus is to provide protection from cold weather. The apparatus has the shortcoming that storing the mask on the back of the hat is aesthetically displeasing. The apparatus has the further shortcoming of lacking a quick and easy way to go from wearing the mask over a mouth and nose to being stowed for storage. A still further shortcoming is a want of a capability for the mask to be cleaned and thereby extending the use of the mask.

In a similar vein, U.S. Pat. No. 1,505,978 teaches the combination of a hat and a fixedly attached chin strap that fits tightly on a user's head to provide warmth. A prominent feature of the disclosed apparatus is to provide protection from cold weather. The apparatus has the shortcoming of not being outfitted for a mask and no storage capability for the chin strap when wearing the chin strap is not desired. A still further shortcoming is a want of a capability for the chin strap to be cleaned and thereby extending the use of the chin strap.

A segment of the community of human beings routinely wear a hat in a near habitual or autonomic fashion without much conscious thought. This human behavioral pattern develops from a variety of motivators. In certain instances, a human being experienced a hair loss and seeks to disguise that hair loss by wearing a hat. In other instances, the human being is doing a work or sport activity in the sun and utilizes a hat with a brim or visor to retard blinding from the sun's bright rays and/or exposure to harmful rays from the sun. Other motivators include a fashion statement.

Accordingly, there exists a need for a face mask that can be stored on-person by an individual who does not utilize a handbag or purse in a convenient, comfortable and aesthetically pleasing manner.

There exists a need for a face mask that can be kept on-person by individual who ritually wears a hat without thought so when the individual appreciates the need for a face mask, the individual has a readily available face mask.

There exists a need for a face mask that can be readily and easily donned, taken off, stored and be available to be easily donned again.

There exists a need for a mask hat that has the capability for the mask to be cleaned and thereby extending the use of the mask.

There exists a need for an improved methodology that can contribute to protecting a community from an airborne illness.

The present invention satisfies these needs, as well as others, and generally overcomes the presently known deficiencies in the art.

SUMMARY OF THE INVENTION

The present invention is directed to facial masks that filter out a harmful particle.

An object of the present invention is a face mask that can be conveniently stored on-person by an individual who does not utilize a handbag or purse.

Another object of the present invention is for a face mask that can be kept on-person by an individual without thought so when the individual appreciates the need for a face mask, the individual has a readily available face mask.

Another object of the present invention is a face mask that can be readily and easily donned, taken off, stored and be available to be easily donned again.

Another object of the present invention is a mask hat that has the capability for the mask to be cleaned and thereby extending the use of the mask.

Another object of the present invention is an improved methodology that can contribute to protecting a community from an airborne illness.

One aspect of the invention is a mask hat for wearing by a human user having a head with a nose and a mouth. An embodiment of this aspect of the invention has a hat member having an interior surface. There is a mask member that is capable of snugly covering the mouth and nose of the human user, has a filtration cutoff which impedes the passage of a droplet and particle with the allowance for the passage of air there through and is capable of nesting on the interior surface of the hat member in substantial conformity to a portion of the interior surface of the hat member. There is an attachment means that is elastically stretchable and contractable which fixedly connects the hat member to the mask member such that there is enough stretchability to stretch the mask member away from the hat member and position the mask member over the human user's nose and mouth and enough contractability to contract to a degree where the mask member is held to snugly cover the human user's mouth and nose.

A result being that a human user can wear the mask hat under conditions where there is no desire for protection against inhaling/exhaling a droplet and particle. Under these conditions, the mask member is stowed against the interior surface of the hat member. The human user can also wear the mask hat under conditions where there is a desire for protection against inhaling/exhaling a droplet and particle. Under these conditions, the mask member is deployed substantially over the human user's mouth and nose. The user can quickly and easily go from a mass storage position to an operative position and vice versa. A human who routinely wears a hat has on-person a mask without conscious thought beyond the human's routine practice of wearing a hat.

Another aspect of the present invention is method of extending the use of embodiments of the mask hat by washing.

Another aspect of the present invention is a method of providing a community benefit towards controlling the spread of infection transmitted predominantly by respiratory droplets. The method is to provide a human user who routinely wears a hat with an embodiment of the mask hat according to the present invention. The human user fairly consistently uses the mask hat under conditions of no desire for protection against inhaling/exhaling of a droplet with the mask member in a stowed position stowed against the interior surface of the hat member. The human user fairly consistently uses the mask hat under conditions where there is a desire for protection against inhaling/exhaling a droplet a with the mask member in an operative position deployed substantially over the human user's mouth and nose. A result being that the human user has a mask on-person without conscious thought beyond routinely wearing a hat and the human user can interchange and reverse interchange between a stowed position and an operative position.

The present invention has many advantages which include a face mask that can be conveniently stored on-person without thought so when the individual appreciates the need for a face mask, the individual has a readily available face mask. Another advantage is that an individual can readily and easily don, taken off, store and don again a face mask. Another advantage is community protection from the airborne spread of infectious disease in a manner that is neither noxious to human sensibility nor overly bearing.

BRIEF DESCRIPTION OF DRAWINGS

These and other features, aspects and advantages of the present invention will become better understood with reference to the following description, appended claims and accompanying drawings where:

DETAILED DESCRIPTION OF THE INVENTION

Figure 1:
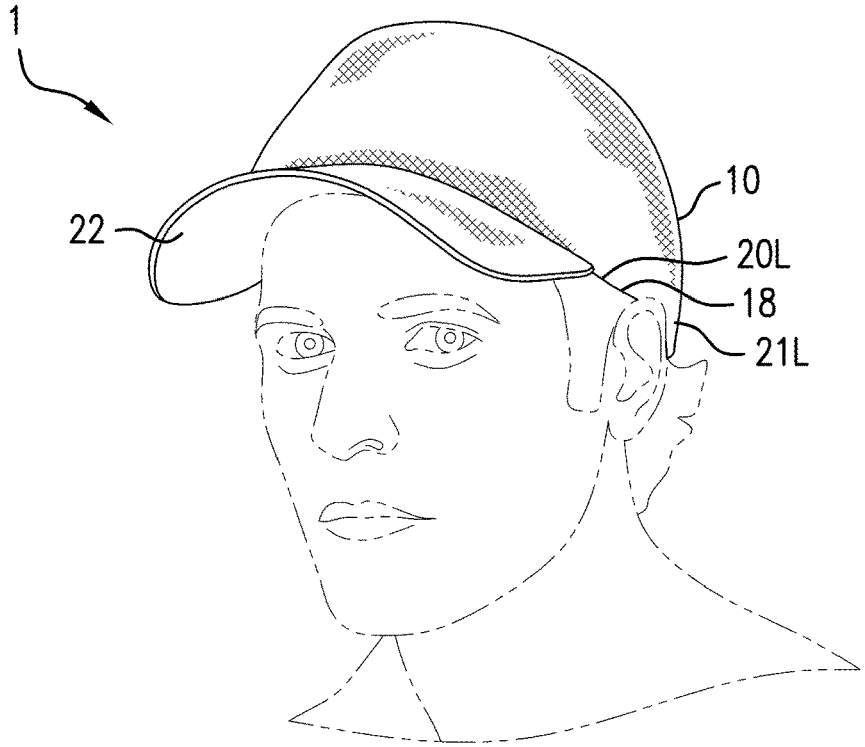
FIG. 1 shows a frontal perspective view of the exterior of an extended use mask hat according to the present invention with a user's head in broken lines to show state of use.

The present invention is described more fully in the following disclosure. In this disclosure, there is a discussion of embodiments of the invention and references to the accompanying drawings in which embodiments of the invention are shown. These specific embodiments are provided so that this invention will be understood by those skilled in the art. This invention is not limited to the specific embodiments set forth herein below and in the drawings. The invention is embodied in many different forms and should be construed as such with reference to the appended claims.

Figure 2:
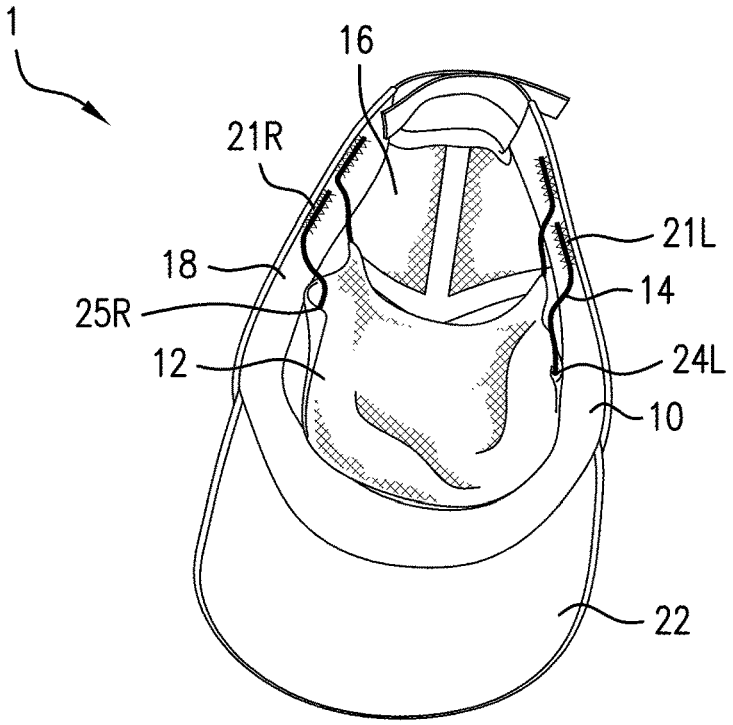
FIG. 2 shows a bottom looking-up perspective view of an extended use mask hat according to the present invention.
Figure 3:
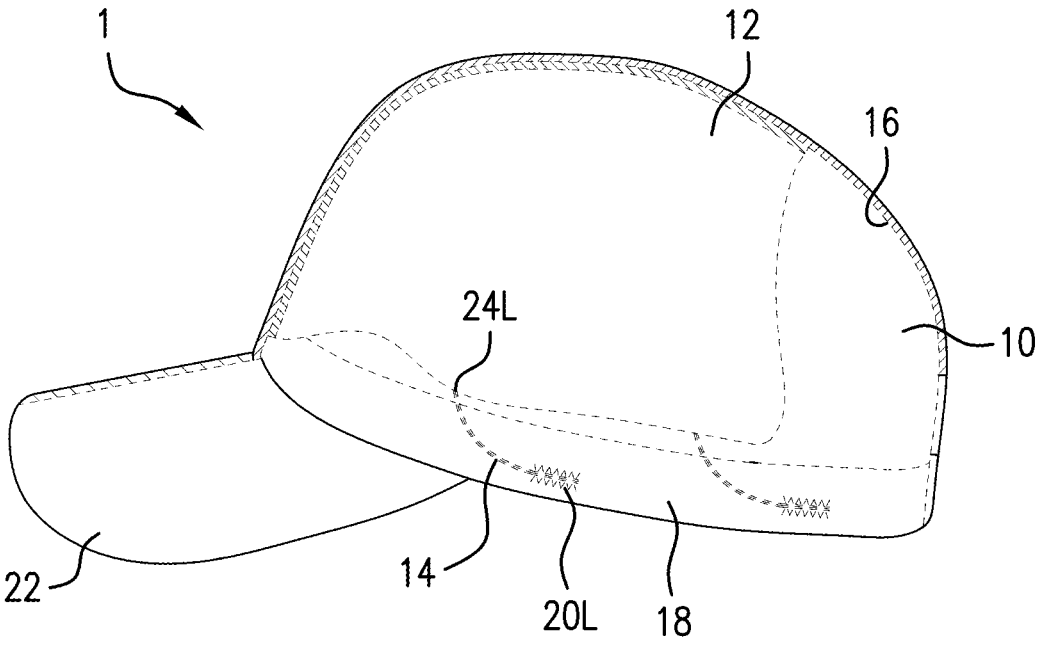
FIG. 3 shows a side elevational a view of an extended use mask hat according to the present invention.

Referring to FIGS. 2 and 3, in general terms and for an overview, embodiments of the mask hat (1) apparatus invention are generally comprised of the following major components or subassemblies: a hat member (10), a mask member (12) and an attachment means (14). In the discussion that follows, each of these major components or subassemblies is discussed, along with other structures that make-up the embodiments of this invention. Thereafter, there is a discussion on how to use the invention.

Referring to FIG. 1, the hat member (10) is a headgear or covering wearable on the top of the head of a human user having a head with nose and mouth. Typically, the hat member (10) is comprised of a standard commercially available head covering commonly worn to provide protection from or block out the sun's ray, as a fashion statement and/or to provide protection from weather (e.g., rain and cold) which is modified to cooperate with the attachment means (14). Examples of commercially available head coverings are a baseball cap, bicycle helmet, cowboy hat, fedora, football helmet, golfer's visor cap, brimmed hat, military helmet, painters cap, straw hat, tam, woolly hat and other headgear worn by sports enthusiasts.

Referring to FIGS. 1 and 2, the hat member (10) has an interior surface (16). Preferable, the hat member (10) has other surfaces to form an enclosure for all or part of the top of the head of the human user. The hat member (10) has relative to being worn on the user's head, a bottom part (18), a fore-left temple region (20L), a fore-right temple region (20R), an aft-left temple region (21L) and an aft-right temple region (21R)(reference numeral 21 also depicts stitching.)

Continuing to refer to FIG. 1 and also FIGS. 6A to 6D, more preferably, the hat member (10) has a brim or visor (22) so as to be a brimmed or visored hat. The brim or visor (22) is of sufficient width and sturdiness that a jerking torque can be exerted to the hat member (10) in its entirety via the brim or visor (22) such that a torque is generated whereby the mask member (12) is flipped and lands nested on the interior surface (16) of the hat member (10) in substantial conformity to a portion of the interior surface (16) of the hat member (10). This is discussed further below.

Figure 7:
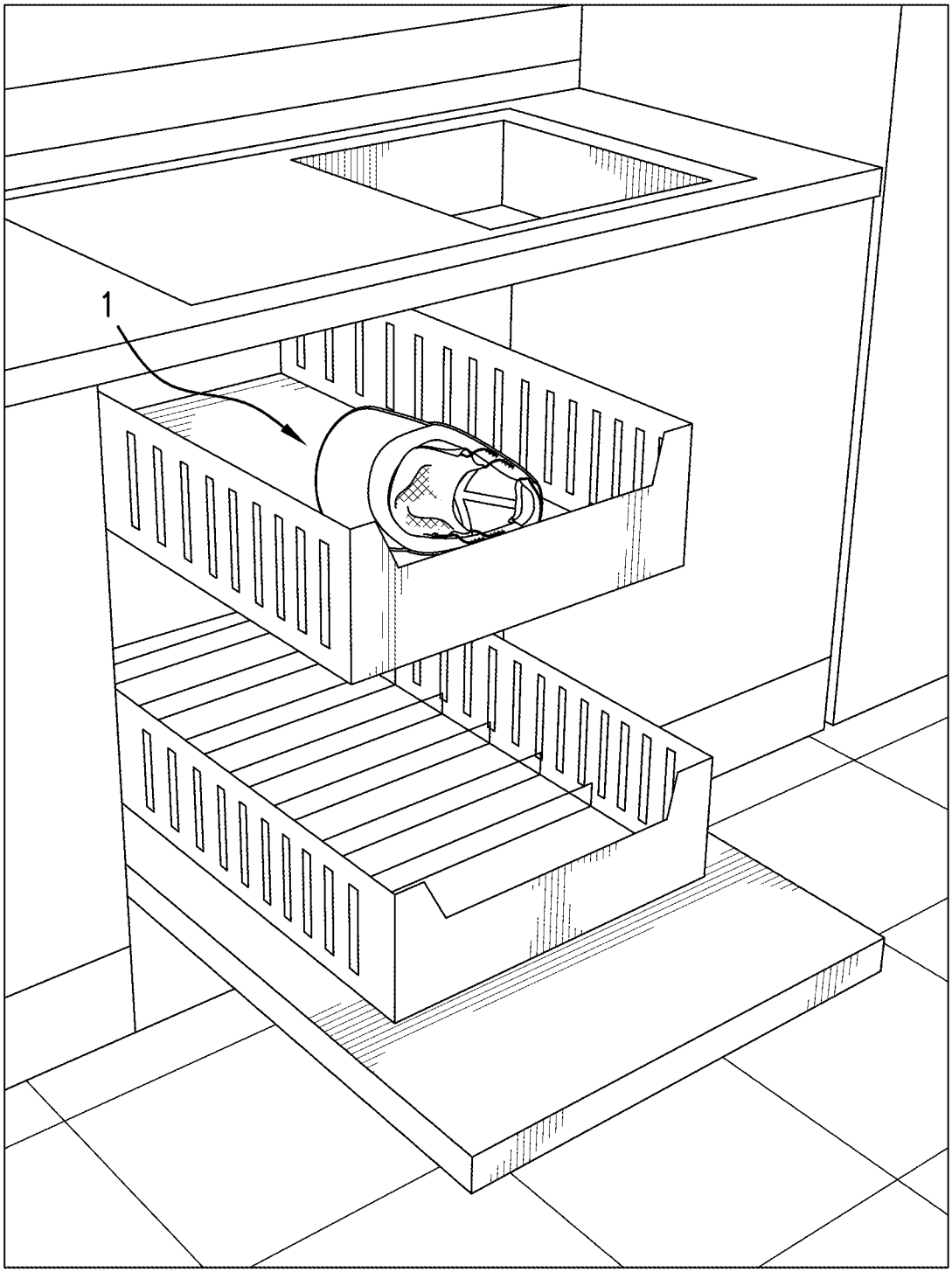
FIG. 7 shows an extended use mask hat placed in a dishwasher for cleaning according to the present invention.

Referring to FIG. 7, preferably, the hat member (10) is sufficiently sturdy and robust to withstand washing on the top rack of a typical household dishwasher. This facilitates a method of using an embodiment of the mask hat (1) invention to extend the service period of the mask hat (1); namely, washing when dirty and/or there is a concern of contamination by say a virion. This is discussed further below.

Figure 5A:
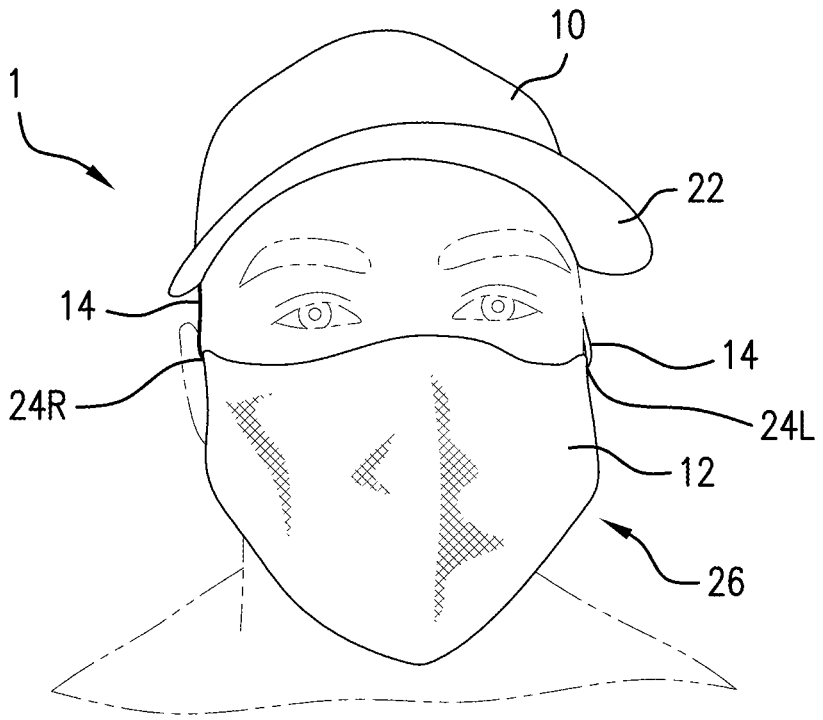
FIG. 5A is a front elevational view an extended use mask hat according to the present invention as worn by a user with a user's head in broken lines to show state of use.
Figure 5B:
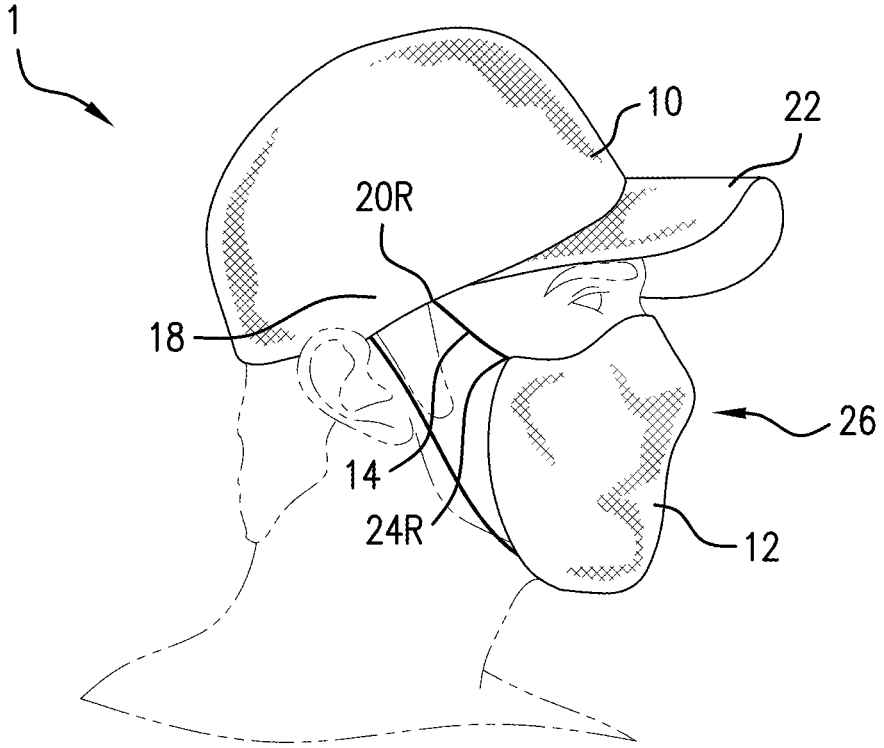
FIG. 5B is a side elevational view an extended use mask hat according to the present invention as worn by a user with a user's head in broken lines to show state of use.
Figure 6A:
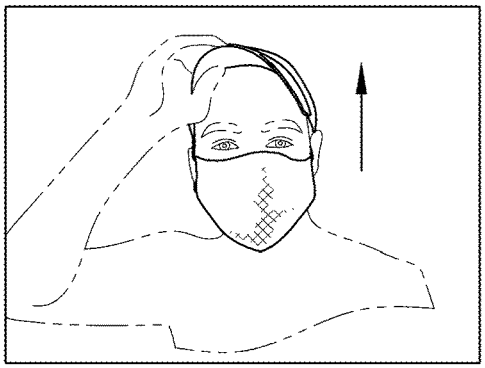
FIG. 6A is the first figure of a six figure sequence of figures that are perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.
Figure 6B:
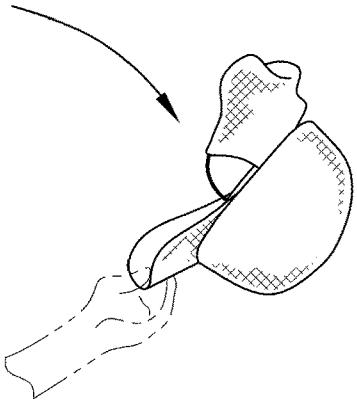
FIG. 6B is the second figure of a six figure sequence of figures that are perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.
Figure 6C:
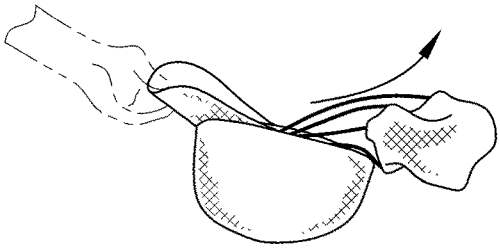
FIG. 6C is the third figure of a six figure sequence of figures that are of perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.
Figure 6D:
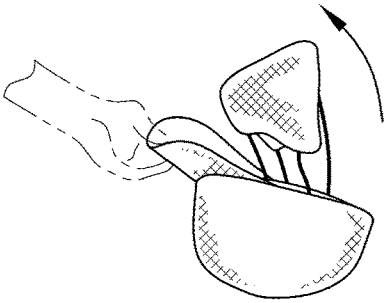
FIG. 6D is the fourth figure of a six figure sequence of figures that are of perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.
Figure 6E:
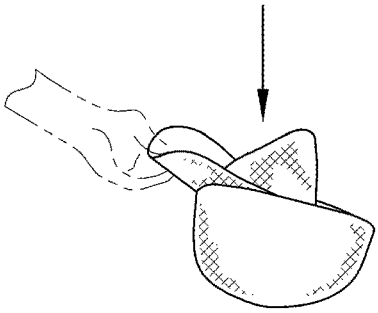
FIG. 6E is the fifth figure of a six figure sequence of figures that are perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.
Figure 6F:
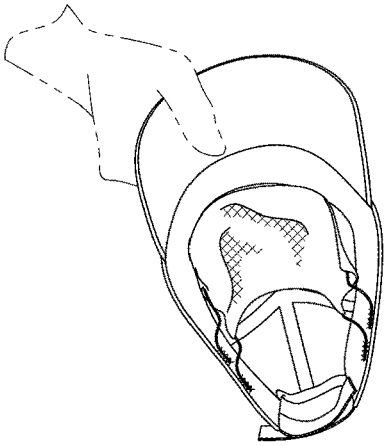
FIG. 6F is the sixth figure of a six figure sequence of figures that are perspective views showing a user rapidly flipping a mask member from a state of the mask member being in an operative position over the user's nose and mouth to a state with the mask member in storage nested on the dorsal surface of a hat member, all according to the present invention with a user's head, torso and hand in broken lines to show environment of use.

Referring FIGS. 5A and 5B, the mask member (12) is a covering for a user's mouth, nose or preferably both which has a filtration cutoff that impedes the passage of a droplet and particle (e.g., corona virus and desert sand) with the allowance for the passage of air there through. Relative to being deployed on the user's face, the mask member (12) has a right upper region (24R, a left upper region (24L), has a right lower region (24R) and a left lower region (24L).

Referring to FIGS. 2 and 5A, the mask member is flexible, pliable and deformable and sized and shaped so as (i) to fit substantially over a human user's mouth, nose or preferably both in a manner that snugly covers the mouth, nose or preferably both of the human user and (ii) to nest on the interior surface (16) of the hat member in substantial conformity to a portion of the interior surface (16) of the hat member (10). Typical materials are cloth, paper fiber materials, plastic and silk. Preferable cloth is cotton and more preferably, multi-layer cotton. Preferable plastics are neoprene and polypropylene. More preferably, the mask is made from cloth. The architecture of the mask material is preferably woven or perforated and a set out above, Embodiments of this invention provide personal protection and community protection against SARS Corona Virus COVID-19. In these embodiments, preferably the mask member (12) has an N95 filtration capacity. More preferably the mask member (12) complies with current guidelines by the United States Centers for Disease Control (CDC) and Prevention. As of Nov. 10, 2020, those guidelines provided that multi-layer cloth masks block release of exhaled respiratory particles into the environment, along with the microorganisms these particles carry. According to the CDC, cloth masks not only effectively block most large droplets (i.e., 20-30 microns and larger,) but, they can also block the exhalation of fine droplets and particles (also often referred to as aerosols) smaller than 10 microns which increase in number with the volume of speech and specific types of phonation. All according to the CDC, multi-layer cloth masks can both block up to 50-70% of these fine droplets and particles and limit the forward spread of those that are not captured. Upwards of 80% blockage has been achieved in human experiments that have measured blocking of all respiratory droplets, with cloth masks in some studies performing on par with surgical masks as barriers for source control.

The CDC guidelines further provide multiple layers of cloth with higher thread counts have demonstrated superior performance compared to single layers of cloth with lower thread counts, in some cases filtering nearly 50% of fine particles less than 1 micron. Some materials (e.g., polypropylene) may enhance filtering effectiveness by generating triboelectric charge (a form of static electricity) that enhances capture of charged particles while others (e.g., silk) may help repel moist droplets and reduce fabric wetting and thus maintain breathability and comfort.

Referring to FIGS. 2 and 3, the attachment means (14) performs the function of connecting the mask member (12) and the hat member (10). Referring to FIGS. 4A, 4B and FIGS. 6A to 6D, the attachment means (14) performs this function in a manner such that a user can manipulate the position of the mask member (12) from a storage position against the interior surface (16) of the hat member (10) to an operative position (26) covering the user's nose and mouth and vice versa.

Referring to FIGS. 5A and 5B, physical structures for the attachment means (14) are comprised of one or more cords, wires, strings, straps and bands (collectively referred to as cords) made from metal, plastic, rubber, rubber substitutes, twine and cloth. An elastic material is preferable. The attachment means runs from a connection with a right region of the mask member (24R, 25R) to a connection with a right temple region (20R, 21R) of the hat member (10) or runs from a connection with a left region of the mask member (24L, 25L to a connection with a left temple region (20L, 21L) of the hat member) (reference numeral 21 also depicts stitching.)

Referring to FIGS. 2 and 3 the attachment means (14) is fastened to the mask member (12) and hat member (10) either permanently or temporarily by sewing (21), clipping, gluing, stapling, riveting, securing with a nut and bolt and/or securing by threading though a tube-like structure. Most preferably, the attachment means (14) is permanently/fixedly fastened to the mask member (12) and hat member (10). The connection point is typically located at a place to relieve tension on user's ears when the mask hat (1) is worn in an operative position (26). (reference numeral 21 also depicts temple regions.)

Figure 4A:
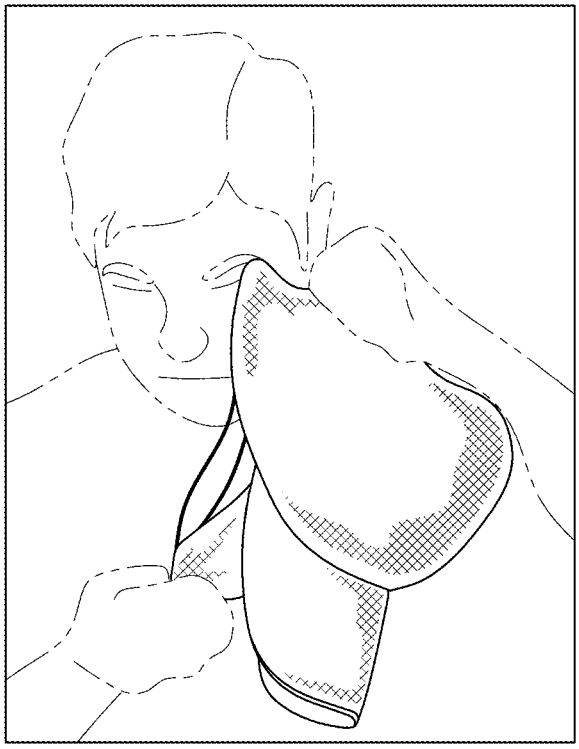
FIG. 4A is the first figure of a two figure sequence of figures that are perspective views showing a user putting on an extended use mask hat according to the present invention with a user's head, torso and arms in broken lines to show environment of use.
Figure 4B:
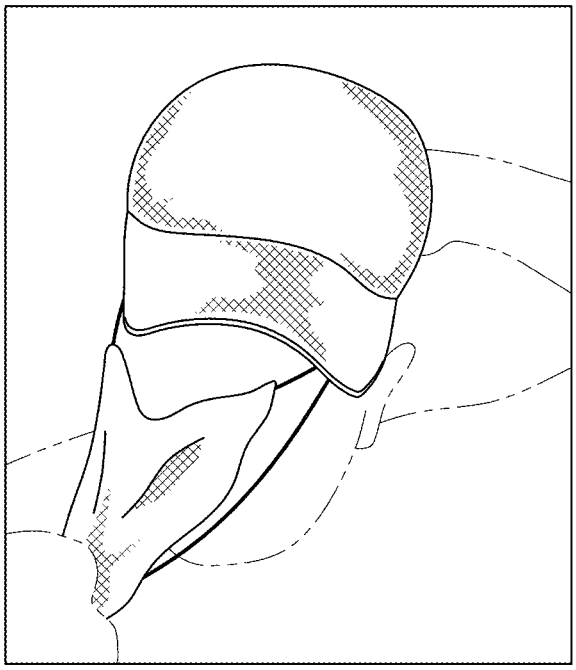
FIG. 4B is the second figure of a two figure sequence of figures that are perspective views showing a user putting on an extended use mask hat according to the present invention with a user's head, torso and arms in broken lines to show environment of use.

Referring to FIGS. 4A and 4B, more preferably, the attachment means (14) is elastically stretchable and contractable such that there is enough stretchability to stretch the mask member (12) away from the hat member (10) and position the mask member over the human user's nose and mouth and enough contractability to relax the stretch for the mask member to be held to snugly cover the human user's mouth and nose in an operative position (26).

Referring to FIGS. 6A to 6D, even more preferably, the attachment means (14) has a length such that a jerking torque exerted to the hat member (10) can flip the mask member (12) from a free hanging position so that is lands nested on the interior surface (16) of the hat member in substantial conformity to a portion of the interior surface (16) of the hat member (10).

As further discussed below, very preferably, the attachment means is comprised of a strap or cord (collectively referred as a cords) having a relaxed and contracted length of about 4 inches to about 6 inches with 5 inches most preferable and an extended and stretched length of about 6 inches to about 8 inches with 7 inches most preferable.

Referring to FIG. 4B, typically, the attachment means (14) is comprised of two or more elastic straps or cords (collectively referred as cords.) One elastic cord makes a connection between a right region (24R or 25R) of the mask member (12) and a right temple region (20R or 21R) of the hat member (10). Preferably, this connection is between the right upper region of the mask (24R) and the fore-right temple region of the hat member (20R). The other elastic cord makes a connection between a left region of the mask member (24L or 25L) and a left temple region (20L or 21L) of the hat member (10). Preferably, this connection is between the left upper region of the mask (24L) and the fore-left temple region of the hat member (20L). The cords have a contracted and relaxed state between about 4 inches to about 6 inches with 5 inches being most preferable and an extended and stretched length of about 6 inches to about 8 inches with 7 inches most preferable. (reference numeral 21 also depicts stitching.)

Figure 8:
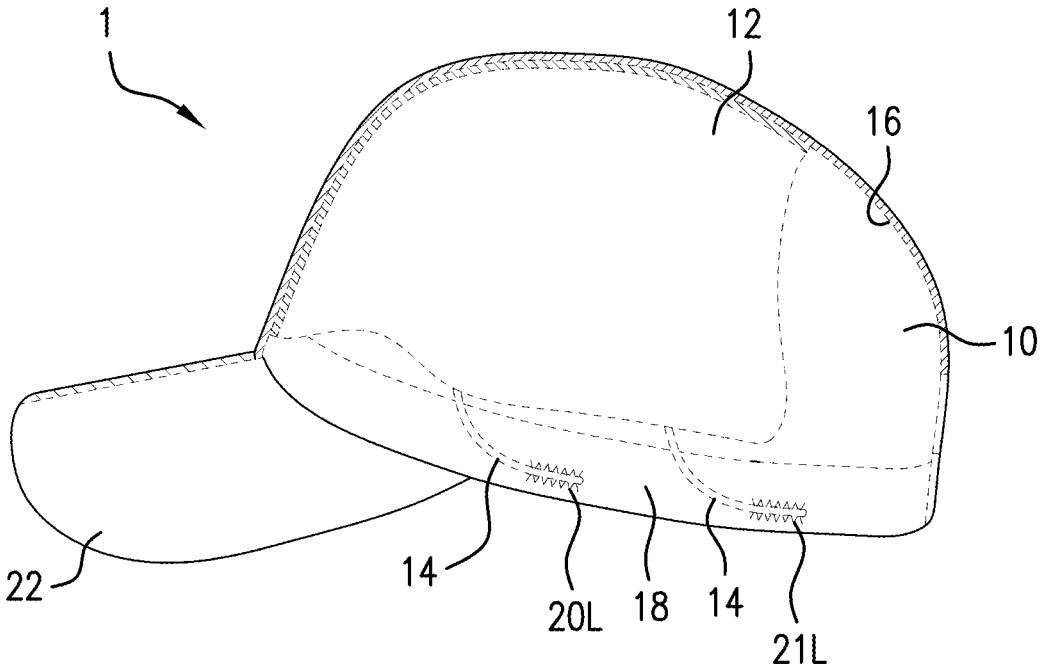
FIG. 8 shows a side elevational a view of an extended use mask hat having two pairs of attachment means according to the present invention (only one pair illustrated)
Figure 9:
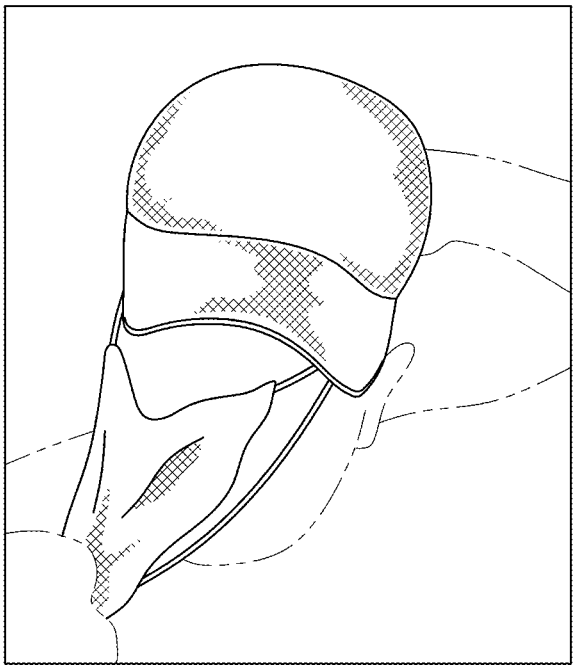
FIG. 9 is a perspective view showing a user putting on an extended use mask hat having two pairs of attachment means according to the present invention with a user's head, torso and arms in broken lines to show environment of use
Figure 10:
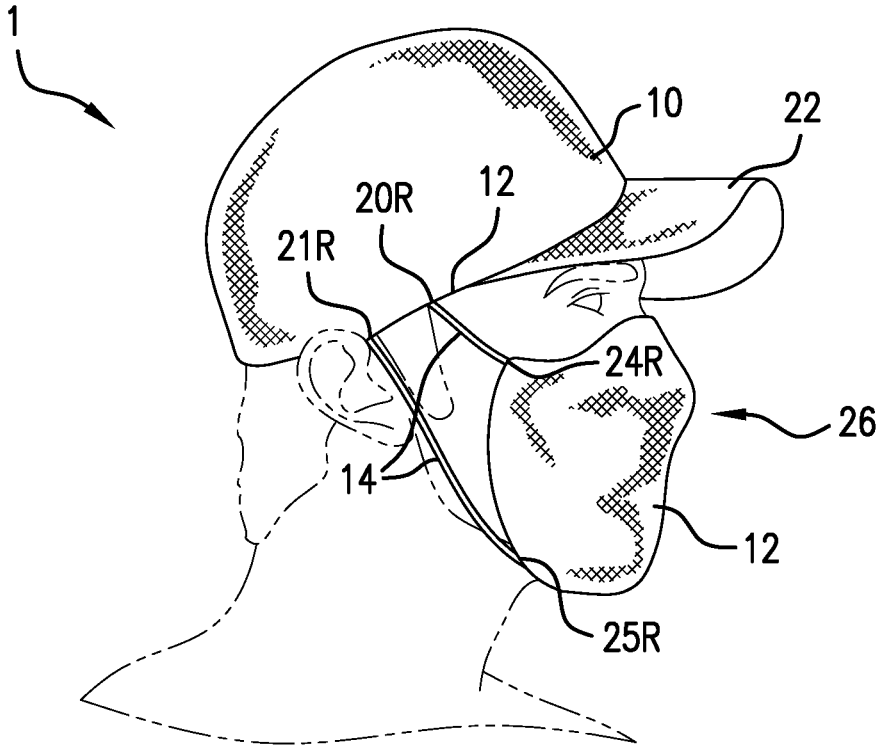
FIG. 10 is a side elevational view an extended use mask hat having two pairs of attachment means according to the present invention as worn by a user with a user's head in broken lines to show state of use (only one pair illustrated).

Referring to FIGS. 8, 9 and 10, more preferably, the attachment means (14) is comprised of four or more elastic straps or cords (collectively referred as cords.) One elastic cord makes a connection between a right upper region (24R) of the mask member (12) and a fore-right temple region (20R) of the hat member (10). Another elastic cord makes a connection between a left upper region (24L) of the mask member (12) and a fore-left temple region (20L) of the hat member (10). Another elastic cord makes a connection between a right lower region (25R) of the mask member (12) and an aft-right temple region (21R) of the hat member (10). Another elastic cord makes a connection between a left lower region (25L) of the mask member (12) and an aft-left temple region (21L) of the hat member (10). The cords have a contracted and relaxed state between about 4 inches to about 6 inches with 5 inches being most preferable.) (reference numeral 21 also depicts stitching.)

Referring to FIGS. 1 and 2, a user can wear embodiments of the mask hat (1) according to the invention under conditions where there is no desire for protection against inhaling/exhaling a particle and the mask member (12) is stored against the interior surface. Referring to FIGS. 5A and 5B, a user can wear embodiments of the extended use mask hat (1) according to the invention under conditions where there is a desire for protection against inhaling/exhaling a particle and the mask member (12) is deployed substantially over the user's mouth and nose regions.

Referring to FIGS. 4A and 4B, a user can quickly and easily go from a mask stowed position (16) under circumstances where wearing a mask is not desired or not required to an operative position (26) under circumstances where wearing a mask is desired or required by way of the following methodology. The user takes the mask hat (1) off of the user's head to access the interior of the hat member (10). The user grasps the mask member (12) and stretches the attachment means (14) so that the mask member (12) is distanced about a face height away from the hat member (10). The user then positions the mask member (12) over the user's nose and mouth. The user than allows the attachment means (14) to contract to a degree where the mask member is conformably held snugly cover the human user's mouth and nose.

Referring to FIGS. 6A to 6D, a user can quickly and easily go from an operative position (26) under circumstances where wearing a mask is desired or required to a storage position (16) under circumstances where wearing a mask is not desired or required by way of the following methodology. The user removes the hat member (10) from the user's head and simultaneously, the mask member (12) falls off the user's mouth and nose and hangs from the hat member (12). The user grasps the mask hat (1) and does so preferably by grasping a brim or visor (22). The user manipulates the mask hat (1) so as to exert a jerking torque. As consequence of the torqueing force, the mask member (12) flips into a storage position on the inner surface (16) of the hat member (10)

Referring to FIG. 7, the service period of the mask hat (1) is extendable with a washing methodology. The mask hat (1) as a whole will become dirty from wear and more particularly, the mask member (12). In a preferred embodiment, the mask member (12) is made from a washable fabric/material, as well as the mask hat as a whole being sturdy for washing (1). The washing methodology is to clean the mask hat (1) utilizing a standard home dishwasher. Preferably, the mask hat (1) is placed on the top rack of a standard home dishwasher and a light cleaning cycle is selected.

Referring to all of the figures, an embodiment of the present invention is a method to provide a community benefit towards controlling the spread of infection transmitted predominantly by respiratory droplets. The methodology being as follows. Human beings who routinely wear a hat are provided with an embodiment of the mask hat (1) according to this invention. These human users fairly consistently use the mask hat (1) under conditions of no desire for protection against inhaling/exhaling of a droplet with the mask member (12) in a stowed position stowed against the interior surface (16) of the hat member (10). These human users fairly consistently use the mask hat (1) under conditions where there is a desire for protection against inhaling/exhaling a droplet a with the mask member (12) in an operative position deployed substantially over the human user's mouth and nose. The human user has a mask on-person without conscious thought beyond routinely wearing a hat and the human user can interchange and reverse interchange between a stowed position and an operative position.

The previously described versions of the present invention have many advantages. One advantage is a face mask that can be conveniently stored on-person by an individual who does not utilize a handbag or purse. Another advantage is that a face mask that can be kept on-person by an individual without thought so when the individual appreciates the need for a face mask, the individual has a readily available face mask. Another advantage is that an individual can readily and easily don, taken off, store and don again a face mask. Another advantage is community protection from the airborne spread of infectious disease in a manner that is neither noxious to human sensibility nor overly bearing.

EXAMPLES

The following examples further describe and demonstrate embodiments within the scope of the present invention. The examples are given solely for the purpose of illustration and are not to be construed as limitations or restrictions of the present invention, as persons skilled in the art will quickly realize many variations thereof are possible that are all within the spirit and scope of the invention.

Example 1

Example one is a negative example. A mask hat like that described in Canadian Patent CN111184305A having two cords that each run from a central point position at about the midpoint of the bottom part of the hat member to an upper region of a mask and to a lower region of a mask member is not practical and workable. The mask cannot be conveniently put over a mouth and nose and snugly conform to a user's face.

Example 2

A mask hat according to the present invention is worn daily with daily washing in a dishwasher. After about six months, the mask hat is hygienic and fully functional.

Example 3

Example 3 is a hypothetical example. A golfer drives a motor vehicle to a golf course without wearing a face mask.

Upon arriving at the golf course, the golfer nearly habitually puts on a multi-position mask hat having visor according to the present invention with the mask member over the golfer's mouth and nose. The golfer is nearly autonomously self-driven to wear a visor hat without conscious thought out of prior conditioning that a visor cap is needed to keep-out sun glare from the golfer's eyes, to protect his face from harmful radiation and/or other reasons.

The golfer proceeds through the clubhouse to check in for a tee time and gets an electric golf cart. The golfer goes on to the course and disposes the mask member on to the rear dorsal surface of the hat member. After golfing, the golfer returns to the clubhouse and for a moment is befuddled by needing to don a mask. Then the golfer appreciates the ready availability of a mask that was stored on the dorsal surface of the hat member.

Although the present invention has been described in considerable detail with reference to certain preferred versions thereof, other versions are possible with substituted, varied and/or modified materials and steps are employed. These other versions do not depart from the invention. Therefore, the spirit and scope of the appended claims should not be limited to the description of the preferred versions contained herein.

What is claimed is:

1. A mask hat for wearing by a human user having a head with a nose and a mouth and comprised of:

a) hat member having:

i) an interior surface and ii) a bottom part wherein relative to being worn on the human user's head, the bottom part comprising a fore-left temple hat region, a fore-right temple hat region, an aft-left temple hat region and an aft-right temple hat region b) a mask member that:

i) a relative to being deployed on the human user's face, the mask member has a right upper mask region, a left upper mask region, a right lower mask region and left lower mask region ii) is capable of snugly covering the mouth and nose of the human user, iii) has a filtration cutoff which impedes the passage of a droplet and particle with the allowance for the passage of air there through and is capable of nesting on the interior surface of the hat member in substantial conformity to a portion of the interior surface of the hat member and c) an attachment means that:

i) is comprised of four or more elastic cords with at least a first cord fixedly connected between the right upper mask region and the fore-right temple hat region, at least a second cord fixedly connected between the left upper mask region and the fore-left temple hat region, at least a third cord fixedly connected between the right lower mask region and the aft-right temple hat region and at least a fourth cord fixedly connected between the left lower mask region and the aft-left temple hat region;

ii) is elastically stretchable and contractable, which fixedly connects the hat member to the mask member such that there is enough stretchability to stretch the mask member away from the hat member and position the mask member over the human user's nose and mouth and enough contractability to contract to a degree where the mask member is held to snugly cover the human user's mouth and nose, whereby the human user can wear the mask hat under conditions where there is no desire for protection against inhaling/exhaling a droplet and particle with the mask member is capable of being flipped and landing into a stowed position against the interior surface of the hat member and the human user can wear the mask hat under conditions where there is a desire for protection against inhaling/exhaling a droplet and particle with the mask member deployed substantially over the human user's mouth and nose.

2. The mask hat of claim 1 wherein the mask member is selected from the group consisting of a mask having a filtration cutoff that impedes desert sand, a mask having a filtration cutoff that impedes SARS Corona Virus COVID-19, a mask having a filtration cutoff that impedes about 20 micron to about 30 micron droplets and particles, a mask having a filtration cutoff that impedes about 1 micron to about 20 micron droplets and particles, a mask having a filtration cutoff that impedes about 1 micron to about 10 micron droplets and particles, a mask having a filtration cutoff that impedes about fifty percent of fine particles less than 1 micron and a mask having a filtration cutoff that impedes about 50% to about 70% of about 1 micron to about 30 micron droplets and particles.

3. The mask hat of claim 1 wherein the mask member is selected from the group consisting of a non-valved multi-layer cloth, a polypropylene which generates triboelectric charge and silk.

4. The mask hat of claim 1 wherein the hat member is selected from the group consisting of a golfer's visor cap, brimmed hat, cowboy hat, bicycle helmet, military helmet, tam, painters cap and fedora.

5. The mask hat of claim 1 wherein the elastic cords have a relaxed contracted length of about 5 inches and an extended stretched length of about 7 inches.

6. The mask hat of claim 1 wherein the mask hat is washable and whereby the service period of the mask hat is extended by washing.

7. The mask hat of claim 6 wherein the mask hat is washable in a dishwasher.

8. A mask hat for wearing by a human user having a head with a nose and a mouth and comprised of:

a) a hat member having an interior surface and other surfaces to form an enclosure and a bottom part wherein relative to being worn on the human user's head, the bottom part comprising a fore-left temple hat region, a fore-right temple hat region, an aft-left temple hat region and an aft-right temple hat region;

b) a mask member that is capable of snugly covering the mouth and nose of the human user, has a filtration cutoff which impedes the passage of a droplet and particle with the allowance for the passage of air there through and is capable of nesting on the interior surface of the hat member in substantial conformity to a portion of the interior surface of the hat wherein relative to being deployed on the human user's face with the mask member comprising a right upper mask region, a left upper mask region, a right lower mask region and left lower mask region;

c) four or more elastic cords with at least a first cord fixedly connected between the right upper mask region and the fore-right temple hat region, at least a second cord fixedly connected between the left upper mask region and the fore-left temple hat region, at least a third cord fixedly connected between the right lower mask region and the aft-right temple hat region and at least a fourth cord fixedly connected between the left lower mask region and the aft-left temple hat region, whereby the hat member is connected to the mask member such that there is enough stretchability to stretch the mask member away from the hat member and position the mask member over the human user's nose and mouth and enough contractability to contract to a degree where the mask member is held to snugly cover the human user's mouth and nose, whereby the human user can wear the mask hat under conditions where there is no desire for protection against inhaling/exhaling a droplet and particle with the mask member stowed against the interior surface of the hat member and the human user can wear the mask hat under conditions where there is a desire for protection against inhaling/exhaling a droplet and particle with the mask member deployed substantially over the human user's mouth and nose and whereby the human user can exert a jerking torque such that the mask member is capable of being flipped and landing nested on the interior surface of the hat member in substantial conformity to a portion of the interior surface of the hat member.

9. The mask hat of claim 8 wherein the mask member is selected from the group consisting of a mask having a filtration cutoff that impedes desert sand, a mask having a filtration cutoff that impedes SARS Corona Virus COVID-19, a mask having a filtration cutoff that impedes about 20 micron to about 30 micron droplets and particles, a mask having a filtration cutoff that impedes about 1 micron to about 20 micron droplets and particles, a mask having a filtration cutoff that impedes about 1 micron to about 10 micron droplets and particles, a mask having a filtration cutoff that impedes about fifty percent of fine particles less than 1 micron and a mask having a filtration cutoff that impedes about 50% to about 70% of about 1 micron to about 30 micron droplets and particles.

10. The mask hat of claim 8 wherein the mask member is selected from the group consisting of a non-valved multi-layer cloth, a polypropylene which generates triboelectric charge and silk.

11. The mask hat of claim 8 wherein the hat member is selected from the group consisting of a golfer's visor cap, brimmed hat, cowboy hat, bicycle helmet, military helmet, tam, painters cap and fedora.

12. The mask hat of claim 8 wherein the four or more elastic cords each have a relaxed contracted length of about 5 inches and an extended stretched length of about 7 inches.

13. The mask hat of claim 8 wherein the mask member is a visor cap or brimmed hat and whereby the jerking torque is able to be exerted through the visor or brim.

14. The mask hat of claim 8 wherein the mask hat is washable and whereby the service period of the mask hat is extended by washing.

15. The mask hat of claim 14 wherein the mask hat is washable in a dishwasher.

16. A method of providing a community with a segment that routinely wears a hat in a near habitual or autonomic fashion without much conscious thought arising out of behavioral patterns motivated in certain instances by hair loss and seeking to disguise that hair loss by wearing a hat, doing work or sport activity in the sun and seeking to have brim or visor to retard blinding from the sun's bright rays and/or exposure to harmful rays from the sun and/or as a fashion statement with a benefit towards controlling the spread of infection transmitted predominantly by respiratory droplets by:

1) providing a human user who routinely wears a hat with a mask hat according to claim 1;
2) the human user fairly consistently uses the mask hat under conditions of no desire for protection against inhaling/exhaling of a droplet with the mask member in a stowed position stowed against the interior surface of the hat member and
3) the human user fairly consistently uses the mask hat under conditions where there is a desire for protection against inhaling/exhaling a droplet a with the mask member in an operative position deployed substantially over the human user's mouth and nose, whereby the human user has a mask available by virtue of routinely wearing a hat and the human user can interchange and reverse interchange between a stowed position in step 2 and an operative position in step 3.

17. The method of claim 16 wherein the mask hat is washable and whereby the service period of the mask hat is extended by washing.

18. The method of claim 17 wherein a washing step is performed in a dishwasher.

* * * * *